US006664887B1

(12) United States Patent
Fuchs

(10) Patent No.: US 6,664,887 B1
(45) Date of Patent: Dec. 16, 2003

(54) SYSTEM AND DEVICE FOR MEASURING LAPSED TIME FOR A CONTAINER

(75) Inventor: Meir Fuchs, Tel Aviv (IL)

(73) Assignee: D. N. N. Roekoe Inc., Wilmington, DE (US)

( * ) Notice: Subject to any disclaimer, the term of this patent is extended or adjusted under 35 U.S.C. 154(b) by 76 days.

(21) Appl. No.: 09/950,664

(22) Filed: Sep. 13, 2001

(51) Int. Cl.[7] ..... G08B 1/00

(52) U.S. Cl. ..... 340/309.15; 340/309.4; 340/545.6; 340/384.7; 340/815.69

(58) Field of Search ..... 340/309.15, 309.4, 340/545.6, 384.7, 815.69; 368/10, 107, 109, 278

(56) References Cited

U.S. PATENT DOCUMENTS 4,262,284 A * 4/1981 Stieff et al. ..... 340/568
4,419,016 A * 12/1983 Zoltan ..... 368/10
5,515,030 A * 5/1996 Citron et al. ..... 340/545
5,575,383 A * 11/1996 Seeley ..... 340/384.7
5,751,661 A * 5/1998 Walters ..... 368/10
5,798,694 A * 8/1998 Reber et al. ..... 340/540
5,805,051 A * 9/1998 Herrmann et al. ..... 340/309.4
6,142,146 A 11/2000 Abrams et al.
6,145,697 A 11/2000 Gudish et al.
6,202,540 B1 3/2001 Johnson et al.
6,292,687 B1 * 9/2001 Lowell et al. ..... 600/515

* cited by examiner

*Primary Examiner*—Jeffery Hofsass
*Assistant Examiner*—Hung Nguyen
(74) *Attorney, Agent, or Firm*—G. E. Ehrlich

(57) ABSTRACT

A device and system for determining the status of the contents of a container by measuring the period of time which has elapsed since the opening of the container. The present invention provides a flexible mechanism for enabling the user to determine the usability or efficacy of the contents of the container, since such contents typically experience a higher rate of degradation once the container has been opened. Furthermore, the manufacturer is able to provide information related to the expiration date of an unopened container at the time of manufacture, but cannot determine the time at which the container is opened, and hence the expiration date after opening.

21 Claims, 3 Drawing Sheets

SYSTEM AND DEVICE FOR MEASURING LAPSED TIME FOR A CONTAINER

FIELD OF THE INVENTION

The present invention relates to a system and device for measuring a time period for a container, and in particular, to such a system and device in which the amount of time which has elapsed since the container was opened is measured.

BACKGROUND OF THE INVENTION

Containers are widely used for the storage and distribution of various types of materials. Many such materials are particularly time-sensitive, such as chemicals used for scientific and medical research and industrial production, various types of foodstuffs, particularly those which are intended for sensitive populations such as babies, pregnant women, individuals who are ill and the elderly; and medicines. Therefore, containers typically feature a printed date, after which the material inside the container is considered to have "expired" or to no longer be suitable for use and/or consumption.

This method has a number of drawbacks in operation. First, the user needs to examine the container for the date, and to remember to discard the container and its contents after the date has passed. Second, once the container has been opened, the rate of degradation of the contents may increase rapidly. For example, containers which are vacuum-sealed may provide a significant shelf-life for the contents before they expire, but only as long as the container remains sealed. Once the container has been opened, the date printed on the container may no longer be relevant for determining the freshness and/or efficacy of the contents. Since the container may be opened at widely varying times, which are beyond the control of the manufacturer, adding another printed date or other predetermined method for determining the state of the contents would not be useful.

One example of an attempt to overcome the drawbacks inherent in such predetermined information is described in U.S. Pat. No. 6,202,540, which provides a sensor for detecting the quality of a beverage held in a beverage container. A timer starts operating to measure the time elapsed after the sensor detects a temperature of the beverage which is above a particular threshold. This mechanism is useful, in that it provides more immediate information about the contents of the container; however, it is also very complicated, as it relies upon determining the status of the actual contents of the container. For a heated beverage, determining the temperature of the liquid requires only a single thermal sensor. However, for other types of materials, such as chemicals or medicines, the quality of the contents is significantly more complicated, and relies on a host of factors which determine whether the contents are "fresh" or degraded. Therefore, inserting a sensor directly into such contents would not provide sufficient information as to whether the contents are degraded or still viable.

A more useful solution would be sufficiently simple to be operative with a wide variety of containers and their contents, yet would still be flexible. Unfortunately, such a solution is not currently available.

SUMMARY OF THE INVENTION

The background art does not teach or suggest a device or system for determining the status of contents of a container, without directly measuring some parameter related to the contents itself. In addition, the background art does not teach or suggest such a device or system which is flexible, yet simple and easy to use.

The present invention overcomes these deficiencies of the background art by providing a device and system for determining the status of the contents of a container by measuring the period of time which has elapsed since the opening of the container. The present invention provides a flexible mechanism for enabling the user to determine the usability or efficacy of the contents of the container, since such contents typically experience a higher rate of degradation once the container has been opened. Furthermore, the manufacturer is able to provide information related to the expiration date of an unopened container at the time of manufacture,but cannot determine the time at which the container is opened, and hence the expiration date after opening. The present invention enables the manufacturer to also provide information about the expiration date after the container is opened.

Preferably, the amount of elapsed time is displayed to the user with some type of display, which is more preferably a numerical display for displaying the actual elapsed time. Optionally, the display also features an alarm, for alerting the user to a period of elapsed time which is greater than a threshold. More preferably, the time at which the container is opened is determined through a detector for detecting the breaking of a seal or other event related to the opening of the container. Most preferably, such detection is performed by altering the state of an electronic circuit at the time of breaking such a seal, such that a timer is then able to determine when to start measuring the elapsed period of time.

According to the present invention, there is provided a device for measuring elapsed time after a container is opened, comprising: (a) a detector for detecting opening of the container; and (b) a timer activated by the detector after the container is opened, such that the timer starts to measure the elapsed time after being activated by the detector.

According to another embodiment of the present invention, there is provided a system for monitoring a container after opening, comprising: (a) a detector for detecting opening of the container; (b) a timer activated by the detector after the container is opened, such that the timer starts to measure the elapsed time after being activated by the detector; and (c) an analyzer for receiving data from the timer concerning the elapsed time and for triggering at least one event after the elapsed time passes a threshold.

The term "opening the container" hereinafter refers to any action which alters or disrupts the integrity of any portion of the container. As a preferred example, "breaking a seal" refers to the alteration or disruption of a particular portion of the container. It should be noted that a container may optionally feature a plurality of such seals, such that more than one seal should be broken and/or alternatively that only one seal of the plurality is broken when opening the container.

The term "container" hereinafter refers to any object which is capable of holding or containing something. Examples of such containers include, but are not limited to, bottles, cans, jars, cartons, boxes, bags, sacks, barrels, sachets, tanks containing gases or liquids, balloons, and packets.

BRIEF DESCRIPTION OF THE DRAWINGS

The invention is herein described, by way of example only, with reference to the accompanying drawings, wherein.

DESCRIPTION OF THE PREFERRED EMBODIMENTS

Figure 1:
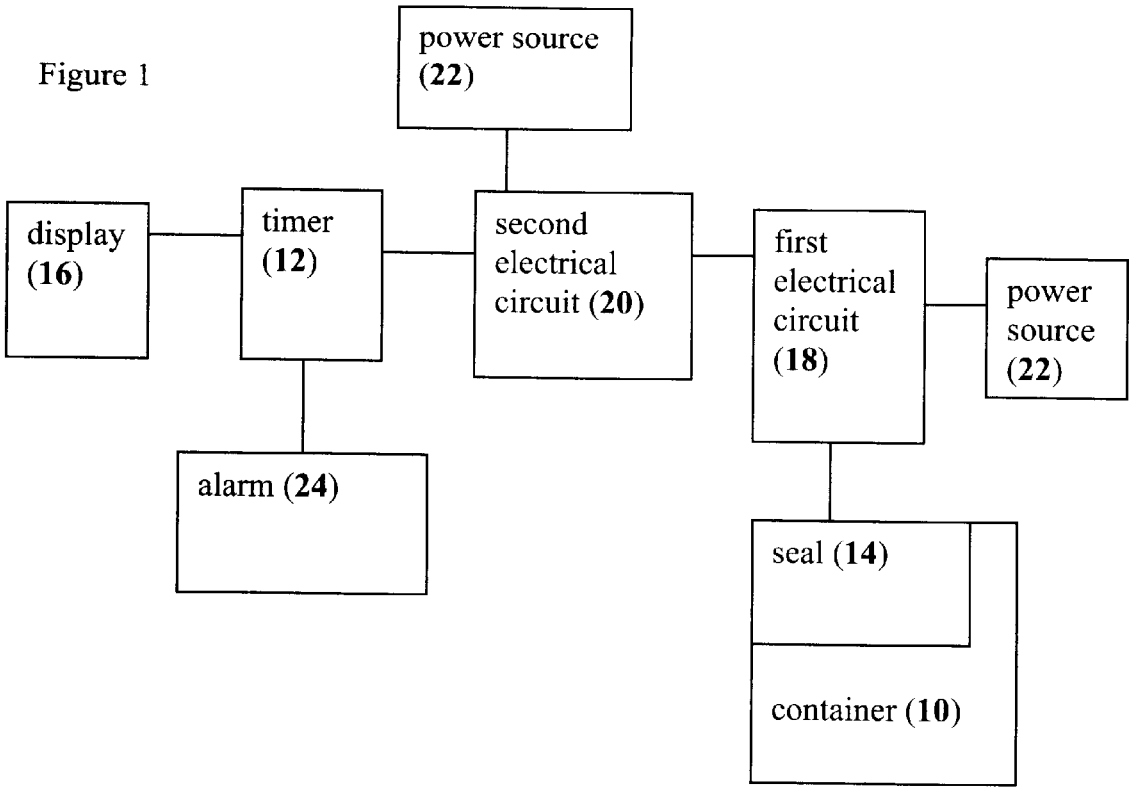
FIG. 1 is a schematic block diagram illustrating an exemplary device according to the present invention for measuring the period of time which has lapsed since a container has been opened.

The present invention is of a device and system for determining the status of the contents of a container by measuring the period of time which has elapsed since the opening of the container. The present invention provides a flexible mechanism for enabling the user to determine the usability or efficacy of the contents of the container, since such contents typically experience a higher rate of degradation once the container has been opened. Furthermore, according to the background art, the manufacturer is able to provide information related to the expiration date of an unopened container at the time of manufacture, but cannot determine the time at which the container is opened, and hence the expiration date after opening. The present invention enables the manufacturer to also provide information about the expiration date after the container is opened.

Preferably, the amount of elapsed time is displayed to the user with some type of display, which is more preferably a numerical display for displaying the actual elapsed time. Optionally, the display also features an alarm, for alerting the user to a period of elapsed time which is greater than a threshold. More preferably, the time at which the container is opened is determined through a detector for detecting the breaking of a seal or other event related to the opening of the container. Most preferably, such detection is performed by altering the state of an electronic circuit at the time of breaking such a seal, such that a timer is then able to determine when to start measuring the elapsed period of time.

According to preferred embodiments of the present invention, an electrical circuit is connected to, integrally formed with, or otherwise in communication with, at least one seal on the container. When the seal is broken, the circuit itself is preferably broken. Breaking this circuit then causes the timer to start measuring elapsed time. More preferably, the container features at least two such electrical circuits, including at least a first such circuit which is broken when the seal is broken, and a second such circuit which then starts to supply power to the timer only after the first circuit is broken. For example, the second circuit could optionally only be completed after the first circuit is broken. More preferably, the first circuit is a shorting circuit which does not draw power.

The display is optionally any type of display, such as a green diode, which turns green upon being opened, or a chemical paper, which is charged electrically and which changes color upon a chemical reaction occurring after power is supplied to the chemical paper. More preferably the display is an electronic numerical display, showing the period of time which has elapsed since the container has been opened. Examples of other suitable displays include, but are not limited to, LCD and LED displays, electroluminescent paper, and any product related to "electrically conducive paper".

Single or dual view timing devices may also optionally be used, in which a first timer would preferably be activated at the time of manufacture, while a second timer would measure the time elapsed after the container is opened.

Without wishing to be limited to a particular type of contents of the container, it should be noted that the present invention is particularly useful for those contents which experience an altered rate of degradation after the container has been opened. Examples of contents include, but are not limited to, chemicals, medicines, and foodstuffs.

The principles and operation of the present invention may be better understood with reference to the drawings and the accompanying description.

Referring now to the drawings, FIG. 1 is a schematic block diagram of a device according to the present invention for measuring the period of time which has lapsed since a container has been opened. As shown, a container 10 features a timer 12 for measuring the elapsed period of time. Timer 12 is preferably connected to, integrally formed with or otherwise in communication with a seal 14, which is broken or otherwise experiences an alteration in its integrity when container 10 is opened. Seal 14 is an example of a portion of container 10 which has altered integrity when container 10 is opened.

Timer 12 then starts to measure the period of time which has elapsed since seal 14 has been broken. Optionally and more preferably, timer 12 is also connected to a display 16 for displaying this measured period of time. Display 16 is preferably some type of numeric or alphanumeric display for displaying the measured period of time to the user. Display 16 is optionally any type of display, such as a green and red diode, which turns green upon being opened and which may then optionally and more preferably turn red upon expiry of the contents; or a chemical paper, which is charged electrically and which changes color upon a chemical reaction occurring after power is supplied to the chemical paper. More preferably display 16 is an electronic numerical display, showing the period of time which has elapsed since the container has been opened. Examples of other suitable displays include, but are not limited to, LCD and LED displays, electroluminescent paper, and any product related to "electrically conducive paper".

As shown, timer 12 is preferably in communication with seal 14 through a first electrical circuit 18. First electrical circuit 18 is preferably connected to, integrally formed with or otherwise in communication with seal 14. Therefore, when seal 14 is broken, first electrical circuit 18 is altered. Optionally, first electrical circuit 18 is altered by being completed. Preferably, first electrical circuit 18 is altered by being disrupted, such that first electrical circuit 18 is more preferably short-circuited.

Upon alteration of first electrical circuit 18, a second electrical circuit 20 is then preferably completed, which supplies power to timer 12. Timer 12 is now activated by the supply of power and begins to measure the elapsed period of time. First electrical circuit 18 and/or second electrical circuit 20 are examples of a detector for detecting an alteration to the integrity of container 10.

First electrical circuit 18 and second electrical circuit 20 may also optionally interact in a number of different ways. For example, second electrical circuit 20 could optionally be completed even before seal 14 is broken, without timer 12 starting to measure elapsed time. For example, timer 12 could be activated by receiving a signal after first electrical circuit 18 is broken, which would start the amount of elapsed time being measured.

Both first electrical circuit 18 and second electrical circuit 20 may optionally receive power from any suitable power source, including but not limited to, a power source 22 as shown, such as a battery for example or a solar/light panel. Both first electrical circuit 18 and second electrical circuit 20 may optionally share a single power source 22, or each of first electrical circuit 18 and second electrical circuit 20 may optionally feature a separate power source 22 as shown.

Optionally, timer 12 is in communication with an alarm 24, which transmits an alarm to the user after the elapsed time passes a threshold. Any suitable type of alarm may optionally be used, including but not limited to an audible alarm, a visible alarm, a transmission to another electronic device for alerting the user, such as a computer for example, or any combination thereof. Alarm 24 may also optionally receive power from power source 22. Alarm 24 may optionally be separate.

Figure 2:
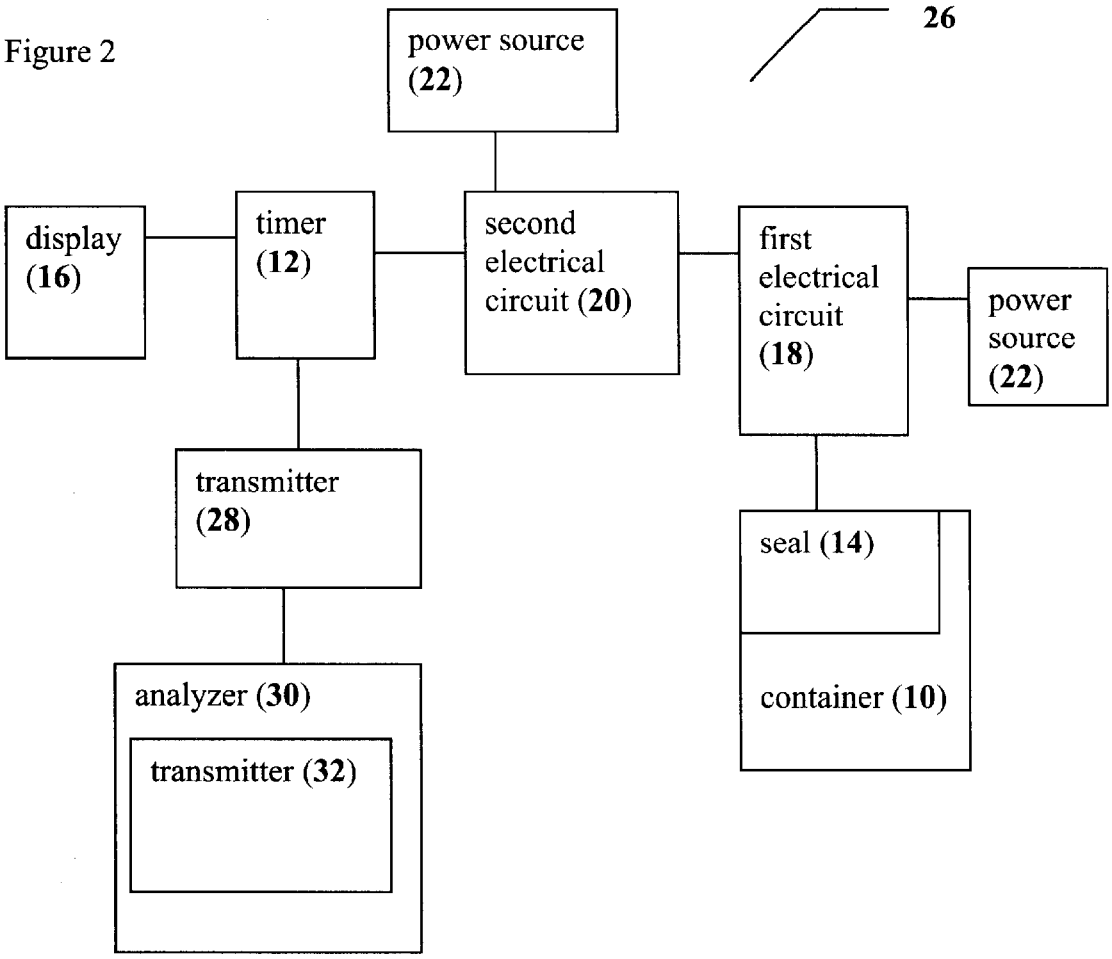
FIG. 2 is a schematic block diagram illustrating an exemplary system according to the present invention for operation with the device of FIG. 1.

FIG. 2 shows a preferred embodiment of the present invention for a system or use with the device of FIG. 1. As shown, a system 26 also features at least some of the components of FIG. 1, although preferably all components are included. Unless otherwise noted, components having the same reference number fulfill the same or a similar function.

System 26 also preferably features a transmitter 28 connected to timer 12 for transmitting data about the elapsed period of time to an analyzer 30. Analyzer 30 then determines whether a sufficient period of time has elapsed to trigger one or more events. For example, a first such event could optionally be alerting the user, for example with an alarm. Another such event could optionally be ordering another container of the material. Of course, many other such events could optionally be featured, in addition to or in place of these events.

Analyzer 30 is more preferably implemented as a computer, although alternatively a microprocessor with associated logic could be used. Analyzer 30 is optionally and preferably connected to a network such as the Internet (not shown) for performing the triggered event, for example to be able to order another container.

Transmitter 28 is optionally and more preferably implemented as a wireless transmitter, such as a Bluetooth-enabled device for example. Bluetooth provides a standard architecture for short-distance wireless (radio) communication (see for example *http://www.bluetooth.com* as of July 11, including "Bluetooth Protocol Architecture"). Alternatively, transmitter 28 could be a wired connection to analyzer 30, for conducting the data from timer 12 to analyzer 30.

An additional transmitter 32 may also optionally be present for transmitting data from analyzer 30, for example to a remote computational device for sounding an alarm (not shown). Additional transmitter 32 is more preferably Bluetooth-enabled.

Figure 3:
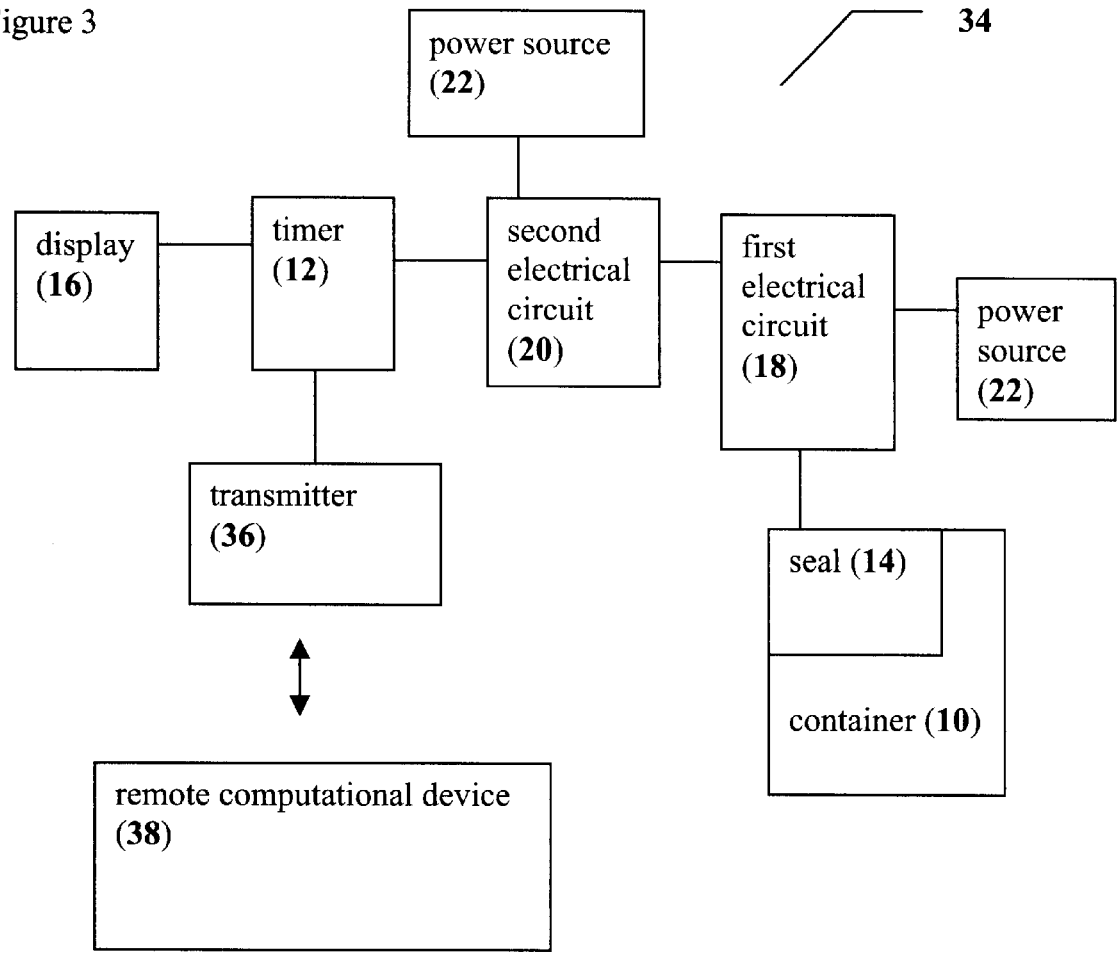
FIG. 3 is a schematic block diagram illustrating another implementation of the system according to the present invention.

An alternative implementation of the system according to the present invention, shown as a system 34 in FIG. 3, features a separate transmitter 36 for transmitting data from timer 12 to a remote computational device 38 for processing. Remote computational device 38 could then optionally perform the different types of processing required for analyzing the data, for example to determine if an alarm should be sounded. Transmitter 36 and the remaining components of the device according to the present invention, such as first electrical circuit 18 and second electrical circuit 20, are preferably contained in a single unit.

Illustrative, non-limiting examples of usage for the system of the present invention include but are not limited to, monitoring containers of medical supplies in a hospital, pharmacy or other medical environment, which optionally and preferably includes automatically ordering new supplies as necessary (or at least alerting the user to order such supplies); and monitoring containers of chemicals in a scientific laboratory or manufacturing environment, which could also optionally and preferably include automatically ordering new supplies as necessary (or at least alerting the user to order such supplies).

While the invention has been described with respect to a limited number of embodiments, it will be appreciated that many variations, modifications and other applications of the invention may be made.

What is claimed is:

1. A device for measuring elapsed time after a container is opened, comprising:

(a) a seal for being broken when the container is opened;

(b) a detector for detecting opening of the container; and (c) a timer activated by said detector after the container is opened, such that said timer starts to measure the elapsed time after being activated by said detector after said seal is broken, wherein said timer measures the total elapsed time after the container is first opened.

2. The device of claim 1, further comprising:

(c) a display for displaying the elapsed time.

3. The device of claim 2, wherein said display is an electronic display.

4. The device of claim 3, wherein said electronic display is selected from the group consisting of green diode, an electrically charged chemical paper, LCD, LED, electroluminescent paper and electrically conducive paper.

5. The device of claim 3, wherein said display is an alphanumeric display.

6. The device of claim 3, further comprising:

(d) an alarm for alerting after the elapsed time is over a threshold.

7. The device of claim 1, further comprising:

(c) an alarm for alerting after the elapsed time is over a threshold.

8. The device of claim 1, wherein said detector comprises at least one electronic circuit for being altered when the container is opened, such that said alteration activates said timer.

9. The device of claim 8, wherein said at least one electronic circuit is completed for said alteration.

10. The device of claim 9, further comprising a power supply for said timer, wherein completing said at least one electronic circuit causes said power supply to supply power to said timer.

11. The device of claim 9, further comprising an additional electronic circuit for being broken when the container is opened, such that breaking said additional electronic circuit completes said at least one electronic circuit.

12. The device of claim 11, wherein disruption of said seal breaks said additional electronic circuit.

13. The device of claim 1, wherein disruption of said seal activates said timer.

14. A system for monitoring a container after opening, comprising:

(a) a seal for being broken when the container is opened;

(b) a detector for detecting opening of the container;

(c) a timer activated by said detector after the container is opened, such that said timer starts to measure the elapsed time after being activated by said detector after said seal is broken, wherein said timer measures the total elapsed time after the container is first opened; and (d) an analyzer for receiving data from said timer concerning the elapsed time and for triggering at least one event after the elapsed time passes a threshold.

15. The system of claim 14, further comprising a transmitter for transmitting data from said timer to said analyzer.

16. The system of claim 15, wherein said transmitter is Bluetooth-enabled.

17. The system of claim 14, further comprising a transmitter for transmitting data from said analyzer.

18. The system of claim 17, wherein said transmitter is Bluetooth-enabled.

19. A system for monitoring a container after opening, comprising:

(a) a detector for detecting opening of the container;

(b) a timer activated by said detector after the container is opened, such that said timer starts to measure the elapsed time after being activated by said detector;

(c) a transmitter for transmitting data from said timer, wherein said timer, said transmitter and said detector are contained in a single unit; and (d) a remote computational device for receiving said data.

20. The system of claim 19, wherein said transmitter is Bluetooth-enabled.

21. A device for measuring elapsed time after a container is opened, comprising:

(a) a detector for detecting opening of the container, said detector comprising a first electronic circuit for being broken upon opening of the container and a second electronic circuit for being formed upon breaking of said first electronic circuit; and (b) a timer activated by said detector after the container is opened by formation of said second electronic circuits such that said timer starts to measure the elapsed time after being activated by said detector.

* * * * *